US012379192B2

(12) United States Patent
Thompson et al.

(10) Patent No.: US 12,379,192 B2
(45) **Date of Patent: *Aug. 5, 2025**

(54) FLEXIBLE METAL/METAL OXIDE AND/OR INTERMETALLIC REACTANT RIBBON CUTTING SYSTEM

(71) Applicant: The United States of America, as Represented by the Secretary of the Navy, Crane, IN (US)

(72) Inventors: Clayton A. Thompson, Fountain Valley, CA (US); Paul D. Faucheux, Stafford, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/619,487

(22) Filed: Mar. 28, 2024

(65) Prior Publication Data

US 2025/0035411 A1 Jan. 30, 2025

Related U.S. Application Data

(62) Division of application No. 17/733,081, filed on Apr. 29, 2022, now Pat. No. 11,976,908.

(51) Int. Cl.
*F42B 3/087* (2006.01)
*F42D 3/02* (2006.01)
(Continued)

(52) U.S. Cl.
CPC ..... *F42B 3/087* (2013.01); *F42D 3/02* (2013.01); *F41H 11/14* (2013.01); *F42B 3/22* (2013.01)

(58) Field of Classification Search
CPC .. F42B 3/00; F42B 3/087; F42B 3/093; F42B 4/00; F42B 4/02; F42B 4/26; F42B 33/06; F42B 33/067; F42B 99/00; F42D 1/00; F42D 1/04; F42D 1/043; F42D 3/00; F42D 3/02; F42D 5/04; F42D 99/00; F41H 9/02; F41H 11/14; C06C 5/06
(Continued)

(56) References Cited

U.S. PATENT DOCUMENTS 3,695,180 A * 10/1972 Stetter ..... F42B 4/26 102/513
3,792,660 A * 2/1974 Plumer ..... F42D 1/06 102/275.5
(Continued)

FOREIGN PATENT DOCUMENTS

GB 2049890 A * 12/1980 ..... C06C 5/06

*Primary Examiner* — James S Bergin
(74) *Attorney, Agent, or Firm* — Naval Surface Warfare Center, Crane Division; Christopher Feigenbutz

(57) ABSTRACT

Provided is a blast-free alternative tool for breaching operations for the intended purpose of cutting metal, including rebar, steel cables, I-beams, thin walled containers, welding doors, and the like. The apparatus includes a flexible and cuttable tube containing metal oxide/metal (thermite) mixture, capable of being formed around a target material and of NONEL ignition. The apparatus can be used to cut, weld, or ignite target material. Protective caps are included with provisions to insert shock tube or time fuse to transmit ignition to first fire mix. A fire proof or flame retardant flexible outerwrap with adhesive (such as hydrogel) or malleable retention wires covers the cutting ribbon for heat and slag retention. In the preferred embodiment, the apparatus is issued/manufactured in rolls or precut lengths.

13 Claims, 8 Drawing Sheets

(51) Int. Cl.
*F41H 11/14* (2006.01)
*F42B 3/22* (2006.01)

(58) Field of Classification Search
USPC ..... 102/335, 358; 266/54, 70
See application file for complete search history.

(56) References Cited

U.S. PATENT DOCUMENTS

| | | | | |
|---|---|---|---|---|
| 3,869,987 | A * | 3/1975 | Berchielli | F42B 4/26 102/358 |
| 7,555,986 | B2 * | 7/2009 | Givens | F42D 3/02 148/194 |
| 11,007,593 | B1 * | 5/2021 | Gotzmer | B23K 7/00 |
| 11,287,239 | B1 * | 3/2022 | Polk | F42D 1/04 |
| 11,976,908 | B2 * | 5/2024 | Thompson | F42B 3/087 |

* cited by examiner

FLEXIBLE METAL/METAL OXIDE AND/OR INTERMETALLIC REACTANT RIBBON CUTTING SYSTEM

CROSS-REFERENCE TO RELATED APPLICATIONS

The present application is a divisional of U.S. Non Provisional patent application Ser. No. 17/733,081, filed Apr. 29, 2022, entitled "FLEXIBLE METAL/METAL OXIDE AND/OR INTERMETALLIC REACTANT RIBBON CUTTING SYSTEM," which claims priority to U.S. Provisional Patent Application Ser. No. 63/182,127, filed Apr. 30, 2021, entitled "FLEXIBLE METAL OXIDE RIBBON CUTTING SYSTEM," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200630US03) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD OF THE INVENTION

The field of invention relates generally to metal cutting. More particularly, it pertains to a blast-free alternative tool for breaching operations for the intended purpose of cutting metal, including rebar, steel cables, I-beams, thin walled containers, welding doors, and the like.

BACKGROUND

Dynamic entry, i.e. breeching, with explosives can create significant overpressure, which can cause cumulative physiological damage due to blast exposure. Certain operations—such as cutting rebar, locks, chains, cables, bars, I-beams, or welding doors and access points—can be accomplished with alternative energetic tools, such as acetylene/oxygen torches or thermal lances, which are bulky and not always expedient. Other methods include the use of explosive charges, which are very effective but can cause significant overpressure. Torches can be bulky and are not always expedient. Thermite grenades have been around for decades, but are not configured for the same use or for remote activation, and in addition, they are difficult to attach to targets.

Conventional explosives were readily available and easily adaptable to perform the actions needed. It was only recently, however, that significant attention was payed to the cumulative nature of overpressure on long-term health of personnel in harm's way. Torches were also readily available. It is possible that due to the specialized nature of the mission, and availability of tool that were "good enough", that improvements such as the invention provides, were not conceptualized. The invention provides lightweight one-time-use alternatives to bulky equipment. The invention also allows for initiation using existing methods (i.e. nonel or shock tube).

SUMMARY OF THE INVENTION

The present invention relates to a blast-free alternative tool for breaching operations for the intended purpose of cutting metal, including rebar, steel cables, I-beams, thin walled containers, welding doors, and the like. The system includes a flexible and cuttable tube containing metal oxide/metal (thermite) mixture, which is capable of being formed around a target material and an ignition system. The apparatus can be used to cut, weld, or ignite a desired target material. Protective caps are included with provisions to insert a shock tube or time fuse to transmit ignition to the first fire mix. A fire proof or flame retardant flexible outer-wrap with adhesive or malleable retention wires covers the cutting ribbon for heat and slag retention. In the preferred embodiment, the apparatus is issued/manufactured in rolls or precut lengths.

According to an illustrative embodiment of the present disclosure, it is an object of the invention to provide a blast-free alternative tool for breaching operations that creates negligible over pressure.

According to a further illustrative embodiment of the present disclosure, it is an object of the invention to provide a blast-free alternative tool for breaching operations with reduced noise to reduce the possibility of alerting opposing forces of personnel position.

According to a yet another illustrative embodiment of the present disclosure, it is an object of the invention to provide a blast-free alternative tool for breaching operations with a long shelf life and reduced carry weight that can be spread amongst multiple personnel.

According to a still another illustrative embodiment of the present disclosure, it is an object of the invention to provide a blast-free alternative tool for breaching operations with charges that can be tailored to known target dimensions for rapid placement.

According to another illustrative embodiment of the present disclosure, it is an object of the invention to provide a blast-free alternative tool for breaching operations with lower hazard class for transportation.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, the flexible metal/metal oxide ribbon cutting system is configured in various embodiments, including slow burning, rapid burning, instantaneous burning, and ablatement burning. The terms "metal/metal oxide", "thermite", and/or "intermetallic reactant" can be used interchangeably. The system can be initiated from one or both ends. Any embodiment can include a malleable wire core to hold shape as cutting ribbon is formed around target. The system can be cut to a desired length, emplaced, wrapped in a flexible thermal retention wrap, and utilized as necessary.

Figure 1:
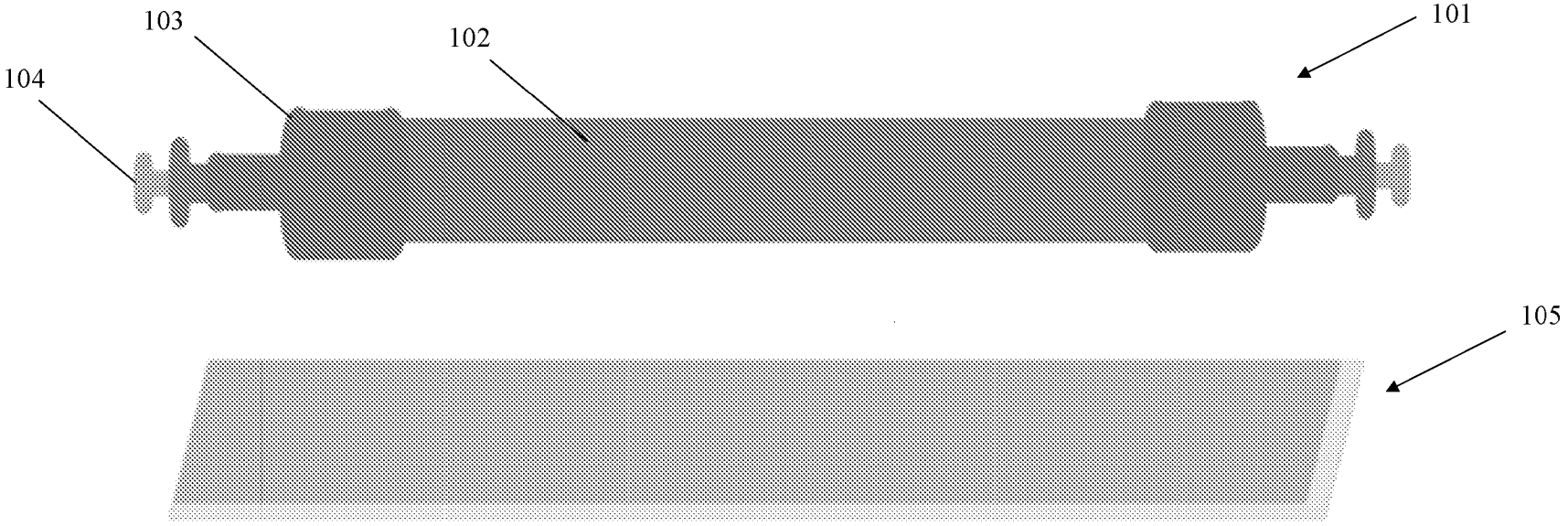
FIG. 1 shows a view of the flexible metal/metal oxide ribbon cutting system.

FIG. 1 shows a view of the flexible metal/metal oxide ribbon cutting system 101. The system includes a flexible and cuttable outer tube 102 containing metal oxide/metal material. In an illustrative embodiment, the material comprises thermite, which is a pyrotechnic composition of metal powder and metal oxide. When ignited by heat or chemical reaction, thermite undergoes an exothermic reduction-oxidation reaction. Thermite is generally not explosive, but can create brief bursts of heat and high temperature in a small area. Thermite acts in a similar matter to that of other fuel-oxidizer mixtures, such as black powder. The metal oxide/metal material can be formed around a target material. Attachable protective caps 103 include provisions to insert shock tube 104 or time fuse to transmit ignition to first fire mix. In one illustration, shock tube which is branded by Dyno Nobel as NONEL and is a component of a high-explosive initiation system. NONEL utilizes a hollow plastic tube instead of electric wires to deliver a firing impulse to a detonator, making it immune to most of the hazards associated with stray electric current. As is well known, NONEL comprises a small diameter, three-layer plastic tube coated on the interior with a reactive explosive compound, which, when ignited, propagates a low energy signal. The ignition shock tube can be used to cut, weld, or ignite target material.

A fire proof or flame retardant flexible thermal retention wrap 105 that includes an adhesive (such as hydrogel) or malleable retention wires to cover the cutting ribbon for heat and slag retention. In an illustrative embodiment, the flame retardant can be mica or muscovite fabric. In an illustrative embodiment, the shock tube 104 transmits heat and shock to a first fire mixture, which in turn ignites the fill composition in an exothermic redox reaction of the metal oxide/metal and produces slag. Depending on the composition variant, the system may be modified to change the burn rate, output temperature, or incorporate gas generators to provide thrust and eject hot gaseous products. The ejected slag and/or gaseous products, in turn, melt, cut, or weld the target material.

Figure 2:
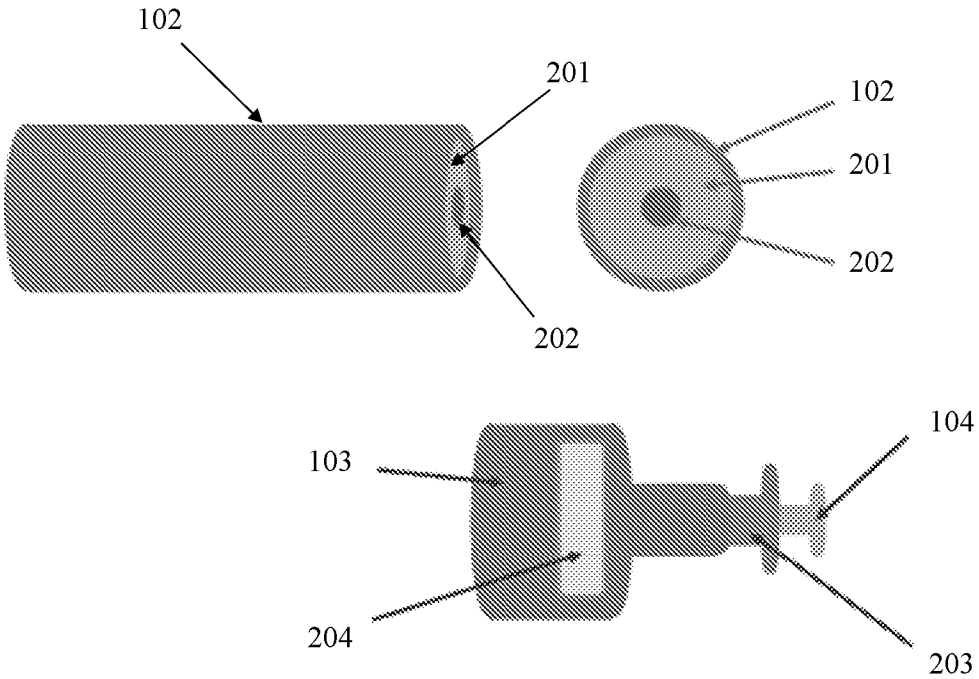
FIG. 2 shows a first slow burning embodiment of the metal oxide/metal cutting ribbon.

FIG. 2 shows a first slow burning embodiment of the metal oxide/metal cutting ribbon. The slow burning embodiment includes a flexible and cuttable outer tube 102 that contains the metal oxide/metal fill 201 as well as ignition or forming components that fit into the end caps 103. The metal oxide/metal fill 201 comprises a mixture that when ignited will produce desired cutting/welding/ignition effect. An optional malleable wire core 202 allows for the outer tube 102 to be bent and shaped to conform to a target profile. The end cap 103 comprises a cap used to seal one or both ends of the outer tube 102 and the components contained therein after it is cut to the desired length. The end cap 103 contains port plugs which, when removed, allow for insertion of time fuse 203 or shock tube 104. The end cap 103 additionally contains a first fire mixture 204 that is ignitable via shock tube 104 or time fuse 203. The first fire mixture 204 is of sufficient thermal output to ignite the metal oxide/metal fill 201.

Figure 3:
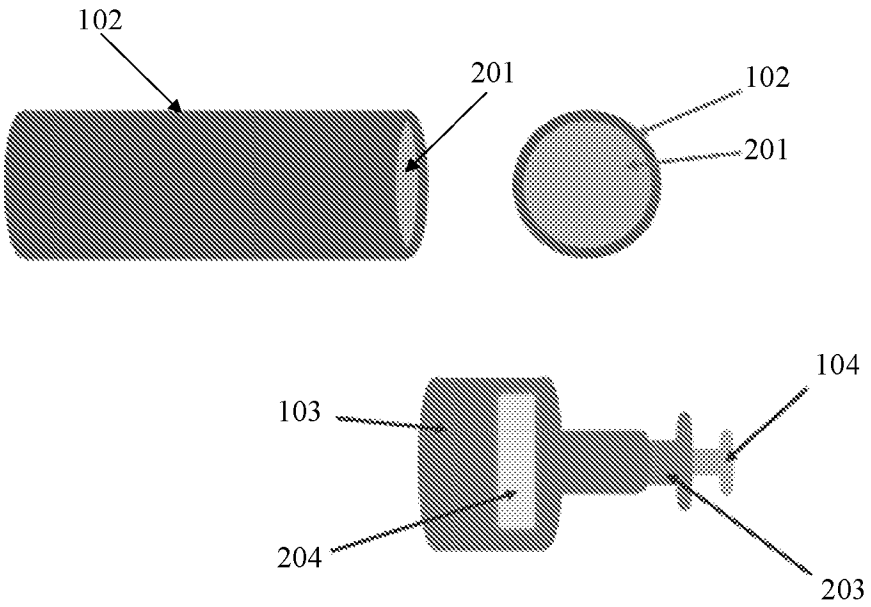
FIG. 3 shows a second slow burning embodiment of the metal oxide/metal cutting ribbon.

FIG. 3 shows a second slow burning embodiment of the metal oxide/metal cutting ribbon. The embodiment described herein includes a flexible and cuttable outer tube 102 that contains the metal oxide/metal fill 201 as well as ignition or forming components that fit into the end caps 103. The metal oxide/metal fill 201 comprises a mixture that when ignited will produce desired cutting/welding/ignition effect. The end cap 103 comprises a cap used to seal one or both ends of the outer tube 102 and the components contained therein after it is cut to the desired length. The end cap 103 contains port plugs which, when removed, allow for insertion of time fuse 203 or shock tube 104. The end cap 103 additionally contains a first fire mixture 204 that is ignitable via shock tube 104 or time fuse 203. The first fire mixture 204 is of sufficient thermal output to ignite the metal oxide/metal fill 201.

Figure 4:
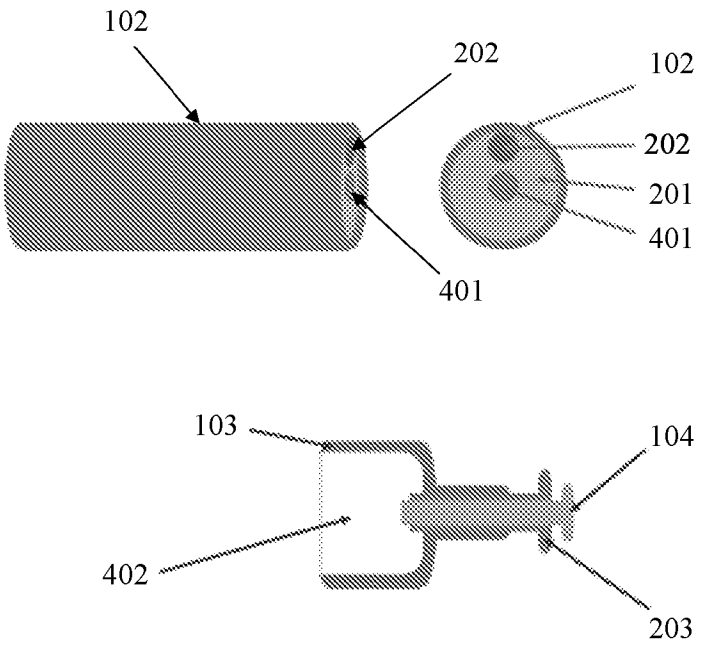
FIG. 4 shows a rapid burning embodiment of the metal oxide/metal cutting ribbon.

FIG. 4 shows a rapid burning embodiment of the metal oxide/metal cutting ribbon. The embodiment described herein includes a flexible and cuttable outer tube 102 that contains metal oxide/metal fill 201 as well as ignition or forming components that fit into the end caps 103. The metal oxide/metal fill 201 comprises a mixture that when ignited will produce desired cutting/welding/ignition effect. A malleable wire core 202 allows for the outer tube 102 to be bent and shaped to conform to a target profile. A rapid first fire core 401 contains first fire mixture which is ignitable via shock tube 104 or time fuse 203, which is of sufficient thermal output to ignite the metal oxide/metal fill 201. In an illustrative embodiment, the rapid fire core, may be a pyrotechnic composition, intermetallic composition, or combination thereof with a burn rate faster than the primary thermite and/or intermetallic reactant fill. The rapid fire core is designed to speed the reaction. Examples of intermetallic reactants could be titanium and boron compounds or zirconium and boron compounds, which can potentially melt metal on their own, or provide sufficient heat of reaction to initiate the thermite reaction. In an illustrative embodiment the first fire core 401 may be solid or utilize hollow geometry to speed up burning. The end cap 103 comprises a cap used to seal one or both ends of the outer tube 102 and the components contained therein after it is cut to the desired length. The end cap 103 contains port plugs which, when removed, allow for insertion of time fuse 203 or shock tube 104. In an illustrative embodiment, the end cap 103 can include a hollow interior 402 that can contain a fire mixture that is ignitable via shock tube 104 or time fuse 203.

Figure 5:
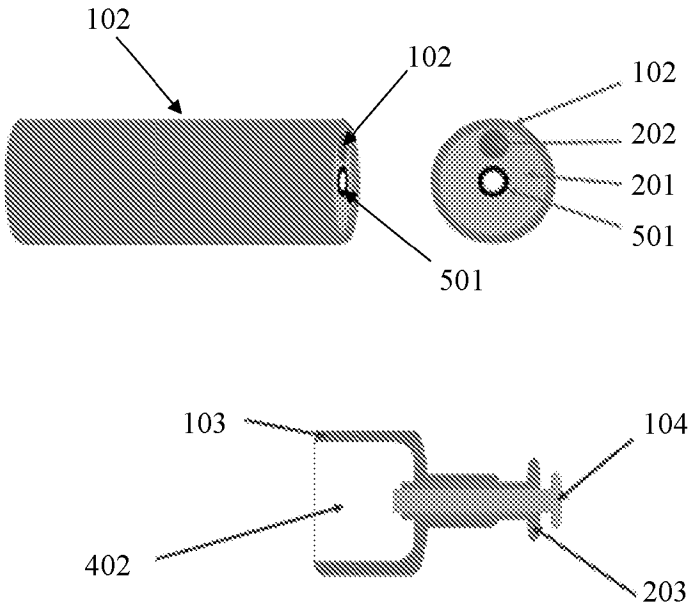
FIG. 5 shows an instantaneous burning embodiment of the metal oxide/metal cutting ribbon.

FIG. 5 shows an instantaneous burning embodiment of the metal oxide/metal cutting ribbon. The embodiment described herein includes a flexible and cuttable outer tube 102 that contains metal oxide/metal fill 201 as well as ignition or forming components that fit into the end caps 103. The metal oxide/metal fill 201 comprises a mixture that when ignited will produce desired cutting/welding/ignition effect. A malleable wire core 202 allows for the outer tube 102 to be bent and shaped to conform to a target profile. In an illustrative embodiment, the instantaneous fire core may be a hollow tube-shaped pyrotechnic composition, intermetallic composition, or combination thereof, coated along the interior with an AL:HMX mixture similar to that of shock tube, or with an alternative such as Aluminum:Ammonium Perchlorate such that the interior coating behaves like shock tube when initiated by shock tube, with the intent of initiating the entire embodiment at once rather than progressively burning from the initiated end to the uninitiated end. The interior of the instantaneous first fire core 501 is comprises HMX explosive to behave as shock tube, wherein it transmits shock through tube as well as simultaneously igniting the first fire mix along entire length thereof. The instantaneous first fire core 501 can also transmit to a shock tube attached at opposite end for incorporation into a series of charges.

Figure 6:
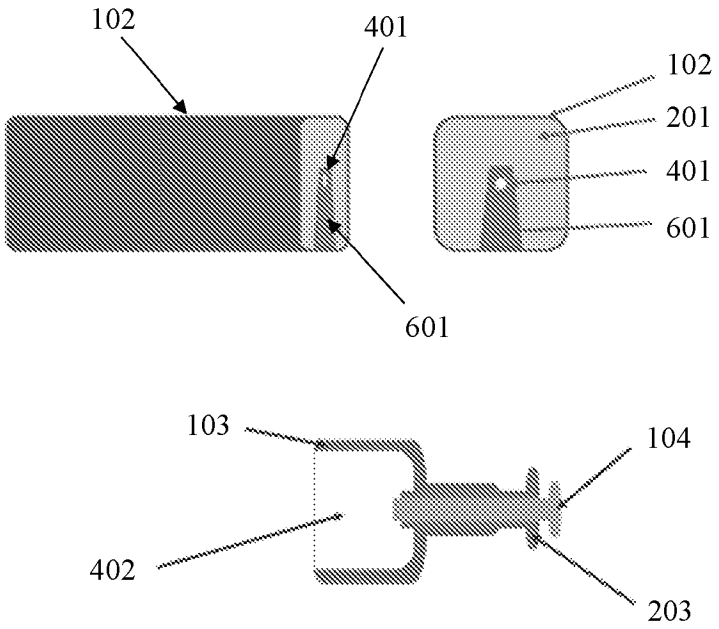
FIG. 6 shows an ablatement burning embodiment of the metal oxide/metal cutting ribbon.

FIG. 6 shows an ablatement burning embodiment of the metal oxide/metal cutting ribbon. The embodiment described herein includes a flexible and cuttable outer tube 102 that contains metal oxide/metal fill 201 as well as ignition or forming components that fit into the end caps 103. The metal oxide/metal fill 201 comprises a mixture that when ignited will produce desired cutting/welding/ignition effect. In an illustrative embodiment the metal oxide/metal fill 201 may be slotted on a desired/target side to aid in direction of gasses. In an illustrative embodiment the metal oxide/metal fill 201 may be flat on desired/target side to aid in alignment during placement. A rapid first fire core 401 contains first fire mixture which is ignitable via shock tube 104 or time fuse 203, which is of sufficient thermal output to ignite the metal oxide/metal fill 201. In an illustrative embodiment the first fire core 401 may be solid or utilize hollow geometry to speed up burning. A first fire nozzle core 601 contains a first fire mixture, which is ignitable via shock tube 104 or time fuse 203, which is of sufficient thermal output to ignite the metal oxide/metal fill 201. In an illustrative embodiment, the fire nozzle core may be a pyrotechnic composition, intermetallic composition, or combination thereof with architecture similar to the rapid fire core and/or instantaneous core or some combination thereof. The first fire nozzle core 601 may be solid or utilize hollow geometry to speed up burning.

Figure 7:
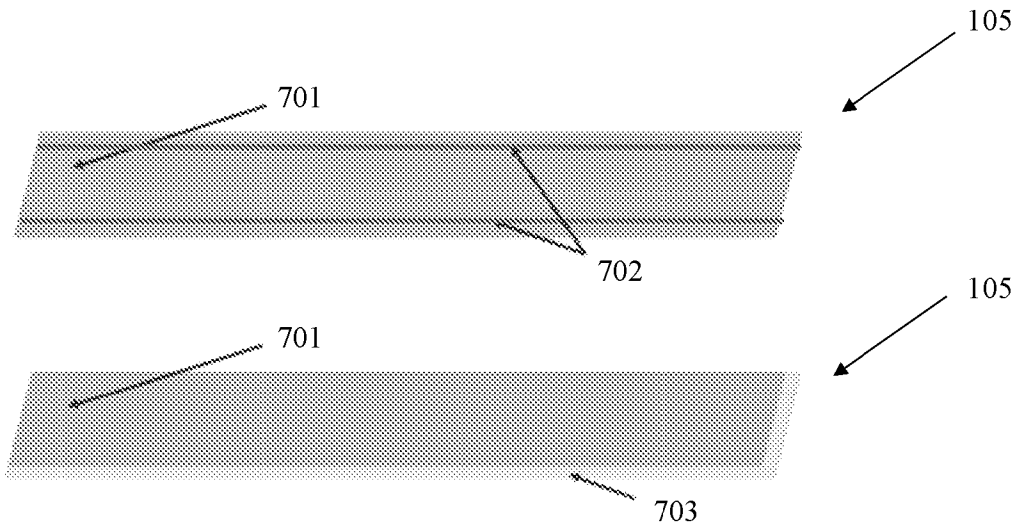
FIG. 7 shows a view of the thermal retention wrap variants.

FIG. 7 shows a view of the thermal retention wrap 105 variants. The thermal retention wrap 105 is designed with the intention of withstanding extreme temperatures of metal/metal oxide reaction for a sufficient duration to increase the dwell time of contact between the reaction products and target material. In a first illustrative embodiment, the thermal retention wrap 105 comprises a fireproof fabric or composite structure 701 containing fireproof ceramics, flexible in nature to enable wrapping of cutting ribbon. The thermal retention wrap 105 is designed to contain slag and thermal products to increase dwell time on target material, thereby increasing efficiency. A malleable embedded wire 702 is embedded in the thermal retention wrap 105 to allow for forming over cutting ribbon. In a second illustrative embodiment, the thermal retention wrap 105 comprises a fireproof fabric or composite structure 701 containing fireproof ceramics, flexible in nature to enable wrapping of cutting ribbon. The thermal retention wrap 105 is designed to contain slag and thermal products to increase dwell time on target material, thereby increasing efficiency. An adhesive backing 703 is used to adhere the thermal retention wrap 105 to a target. In an illustrative embodiment, the thermal retention wrap 105 may incorporate a hydrogel or phase-changing material to prolong time on target.

Figure 8:
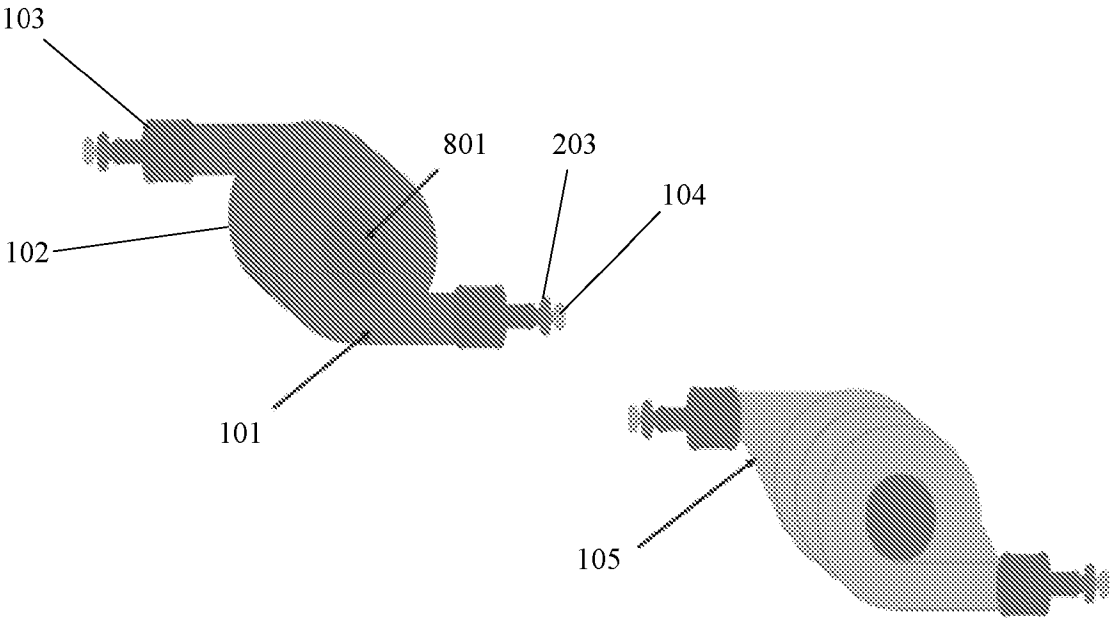
FIG. 8 shows a view of the flexible metal/metal oxide ribbon cutting system emplacement for cutting steel rod/rebar.

FIG. 8 shows a view of the flexible metal/metal oxide ribbon cutting system 101 emplacement for cutting steel rod/rebar 801. Emplacement includes the steps of sizing, assembling, emplacing, and activating. Sizing involves cutting the cuttable outer tube 102 to the desired length. Assembling involves attaching one or two end caps 103 onto the exposed ends. In one illustrative embodiment, one end cap 103 is required. In another illustrative embodiment, two end caps 103 are preferred to ensure that the contents of the outer tube 102 do not dislodge. Shock tube 104 or time fuse 203 are inserted before or after emplacing on target material. To insert shock tube 104 or time fuse 203, remove the appropriate port plug, insert freshly cut piece of shock tube 104 or time fuse 203, taking care to fully seat into port. Emplacing: bend the cuttable outer tube 102 around target material (a steel rod/rebar 801 as shown in this non-limiting embodiment). In one embodiment if the ablatement cutting embodiment is used, it is desirable that the nozzle side of ribbon is pointed towards the target material. The thermal retention wrap 105 is positioned over the cuttable outer tube 102, ensuring that the shock tube 104 or time fuse 203 is not bent or deformed. Finally, the system is activated using shock tube or time fuse capable igniters.

In an alternate embodiment, the system can be utilized by UXO or demining operations to intentionally low-order or deflagrate high explosive filled munitions. In an alternate embodiment, the system can be utilized for controlled burns. In an alternate embodiment, the system can be adapted for underwater use with additional or alternative wrapping methods or materials. In an alternate embodiment, the system can be utilized for the demilling of equipment. In an alternate embodiment, the system can be utilized as a sabotage device. In an alternate embodiment, the system can be utilized for emergency venting/egress systems.

Although the invention has been described in detail with reference to certain preferred embodiments, variations and modifications exist within the spirit and scope of the invention as described and defined in the following claims.

The invention claimed is:

1. A pyrotechnic device comprising:

a flexible and cuttable outer tube;

a first pyrotechnic composition contained within said flexible and cuttable outer tube; and one or more end caps comprising a first fire mixture and a port plug for insertion of a shock tube or a time fuse;

wherein said shock tube or said time fuse transmits heat and shock to said first fire mixture, which in turn ignites said first pyrotechnic composition in an exothermic redox reaction.

2. The device of claim 1, further comprising a fire proof or flame retardant flexible thermal retention wrap that is wrapped around said outer tube.

3. The device of claim 2, wherein said thermal retention wrap comprises a fireproof fabric or composite structure comprising fireproof ceramics.

4. The device of claim 2, wherein said thermal retention wrap comprises a hydrogel or phase-changing material to adhere said wrap to said target.

5. The device of claim 1, wherein said outer tube further comprises a malleable wire core that permits said outer tube to be bent and shaped to conform to a target.

6. The device of claim 1, wherein said first pyrotechnic composition comprises a metal powder and metal oxide and/or intermetallic reactant contained within said outer tube.

7. The device of claim 6, wherein said metal powder and metal oxide comprises thermite.

8. The device of claim 1, further comprising a second pyrotechnic composition.

9. The device of claim 8, wherein said second pyrotechnic composition comprises a rapid fire core comprising a fire mixture that is ignitable via shock tube or time fuse.

10. The device of claim 8, wherein said second pyrotechnic composition comprises an instantaneous fire core comprising a hollow core that contains an HMX explosive that is ignitable via shock tube or time fuse.

11. The device of claim 8, wherein said second pyrotechnic composition comprises a fire nozzle core comprising a solid or hollow geometry that accelerates the burning of said first pyrotechnic composition.

12. The device of claim 1, wherein said shock tube comprises NONEL.

13. The device of claim 1, wherein said end caps further comprise a fire mixture that is ignitable via said shock tube or said time fuse.

* * * * *